United States Patent [19]

Yoshimura

[11] Patent Number: 4,890,991

[45] Date of Patent: Jan. 2, 1990

[54] SCREW ROTOR ASSEMBLY FOR SCREW COMPRESSOR

[75] Inventor: Shoji Yoshimura, Kakogawa, Japan

[73] Assignee: Kabushiki Kaisha Kobe Seiko Sho, Kobe, Japan

[21] Appl. No.: 228,467

[22] Filed: Aug. 5, 1988

[30] Foreign Application Priority Data

Sep. 1, 1987 [JP] Japan ..... 62-218951

[51] Int. Cl.[4] ..... F04C 17/12

[52] U.S. Cl. ..... 418/201 B

[58] Field of Search ..... 418/150, 201 B

[56] References Cited

U.S. PATENT DOCUMENTS

| | | | |
|---|---|---|---|
| 3,773,444 | 11/1973 | Koch | 418/201 B |
| 4,088,427 | 5/1978 | Emanuelsson et al. | 418/201 B |
| 4,140,445 | 2/1979 | Schibbye | 418/201 B |
| 4,350,480 | 9/1982 | Bammert | 418/201 B |
| 4,435,139 | 3/1984 | Astberg | 418/201 B |
| 4,527,967 | 7/1985 | Ingalls | 418/201 B X |

*Primary Examiner*—Michael Koczo

*Attorney, Agent, or Firm*—Oblon, Spivak, McClelland, Maier & Neustadt

[57] ABSTRACT

A screw rotor assembly for a screw compressor or the like includes a male screw rotor and a femal screw rotor having rotor teeth each having a profile consisting of a plurality of special curves designed to reduce both the length of the sealing line and the area of the blow hole. The confugurations of the male and female screw rotors reduces the abrasion of the screw rotor assembly as well as the length of the sealing line and the area of the blow hole, so that the performance of the screw rotor assembly is improved. The length of the sealing length and the area of the blow hole in the screw rotor assembly of the present invention are about 10% and about 50%, respectively, of those of the conventional screw rotor assembly.

1 Claim, 8 Drawing Sheets

SCREW ROTOR ASSEMBLY FOR SCREW COMPRESSOR

BACKGROUND OF THE INVENTION

1. Field of the Invention

The present invention relates to a screw rotor assembly for a screw compressor or a similar apparatus such as a vacuum pump or an expander.

2. Description of the Prior Art

Various profiles for screw rotors for screw compressors or the like have been proposed, for example, in Japanese Patent Laid-open Nos. 59-196988 and 61-190184, and Japanese Patent Publication No. 60-41238.

A profile proposed in Japanese Patent Publication No. 60-41238 is shown in FIG. 12 by way of example. The profile is formed of a plurality of sectional curves. FIG. 12 shows the intermeshing portions of a male rotor 11 and a female rotor 12. A male rotor tooth 11*a* consists of sectional curves a-b, b-c, c-d, d-e, e-f and f-g successively arranged in that order from the leading side to the trailing side, and the female rotor tooth 12*a* consists of sectional curves A-B, B-C, C-D, D-E, E-F, F-G and G-H successively arranged in that order from the leading side to the trailing side. In FIG. 12, indicated at $P_M$ and $P_F$ are the respective pitch circles of the male rotor 11 and the female rotor 12, at $A_M$ and $A_F$ are the respective tip circles of the male rotor 11 and the female rotor 12, and at $D_M$ and $D_F$ are the respective root circles of the male rotor 11 and the female rotor 12.

Generally, the performance of the profile of the screw rotor is dependent mostly on the length of the sealing line and the area of the blow hole, and the performance is improved as both the length of sealing line and the area of blow hole are reduced. However, since a portion of a conventional profile corresponding to the curve e-f of the male rotor tooth 11*a* of the male rotor 11 is an arc of a circle, when either the length of the seal line or the area of blow hole is decreased, the other increases as indicated by a curve I in FIG. 13, and hence it has been impossible to reduce both the length of the sealing line and the area of the blow hole. Furthermore, since a portion of the conventional profile corresponding to the curve C-E of the female rotor tooth 12*a* of the female rotor 12 is formed of two curves respectively defined by two functions, the length of the sealing line is increased inevitably. That is, the respective quadratic derivatives of those functions at the junction of the curves do not coincide with each other. Therefore, a line indicating the variation of the length L of the sealing line in the xy plane with the rotating angle $\psi$ is bent at the junction, and thereby the length of the sealing line is increased as indicated by a broken line I in FIG. 7.

SUMMARY OF THE INVENTION

To solve the foregoing problems in the conventional profile of the screw rotor, the present invention provides a screw rotor assembly comprising a male rotor having male rotor teeth each formed in a profile consisting of curves a-b, b-c, c-d, d-e, e-f and f-g; and a female rotor having female rotor teeth each formed in a profile consisting of curves A-B, B-C, C-D, D-E, E-F and F-G; characterized in that (1) the curve a-b is an arc of the root circle of the male rotor teeth with its center on the center O of the male rotor, (2) the curve b-c is a generated curve corresponding to the curve B-C of the female rotor tooth, (3) the curve c-d is a generated curve corresponding to the curve C-D of the female rotor tooth, (4) the curve d-e is a curve with its origin at a point O″ on a straight line connecting the center O of the male rotor and the center O′ of the female rotor and with a radius $r1=R1+R2(\theta_1/\theta_3)^n$, merging with the tip circle of the male rotor, where $\theta_1$ is a variable, $R2<0$, $|R2|>|R1|/2$, $0<\theta_3<90$, and $1<n<1.5$, (5) the curve e-f is a generated curve corresponding to the curve E-F of the female rotor tooth, (6) the curve f-g is an arc of a circle with its center on the pitch circle of the male rotor, merging with the root circle of the male rotor,.

(7) the curve A-B is an arc of the tip circle of the female rotor, (8) the curve B-C is an arc of a circle, (9) the curve C-D is a curve with its origin at a pitch point O‴ and with a radius $r2=\overline{R}+R3a(\theta_2/\theta_0)^n/\{b+(\theta_2/\theta_0)^n\}$, merging with the root circle of the female rotor, where $\theta_2$ is a variable, $a=\beta(1-\alpha^n)/(\beta-\alpha^n)$, $b=\alpha^n(1-\beta)/(\beta-\alpha^n)$, and when $\beta=0.5$, $0.7\leqq\alpha\leqq0.85$, and $2.5\leqq n\leqq3.5$,

(10) the curve D-E is a generated curve corresponding to the curve d-e of the male rotor tooth,

(11) the curve E-F is a part of a hyperbola having the pole normal to the male rotor tooth at a point E, and

(12) the curve F-G is an arc of a circle with its center on the pitch circle of the female rotor and merging with the tip circle of the female rotor.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
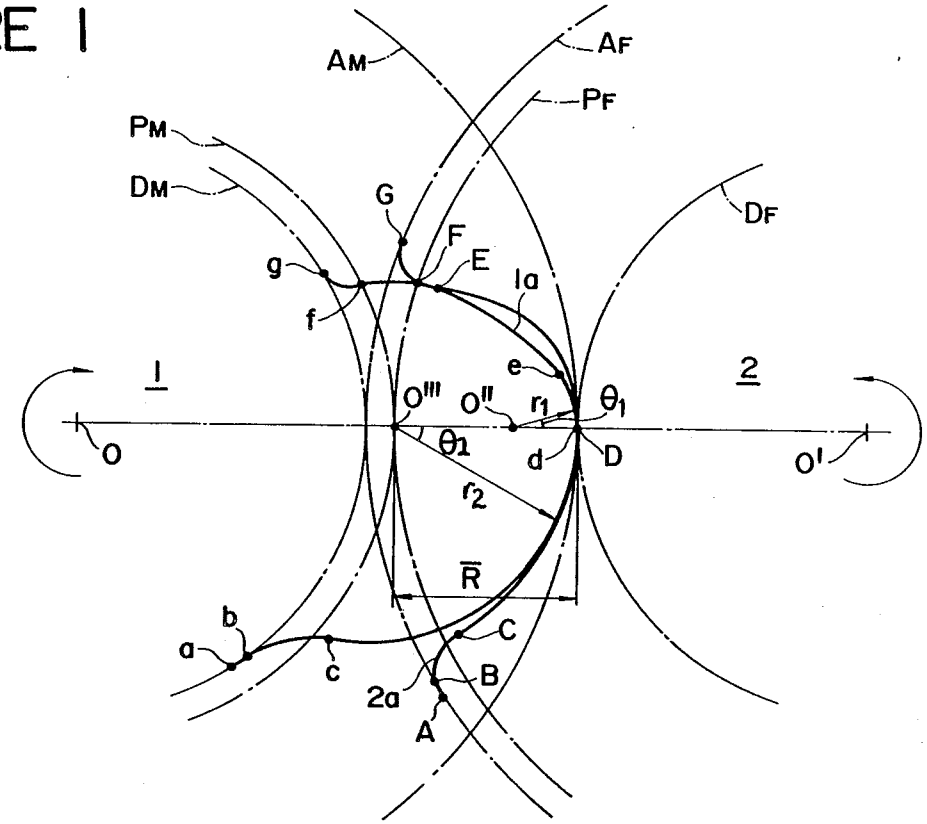
FIG. 1 is a diagram showing the respective profiles of the male and female rotors of a screw rotor assembly in a preferred embodiment according to the present invention.
Figure 12:
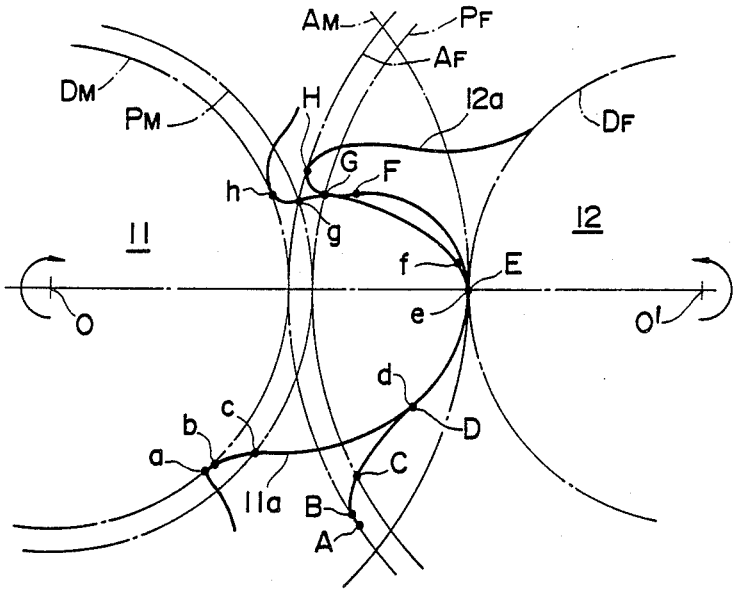
FIG. 12 is a diagram showing the respective profiles of the male and female rotors of a conventional screw rotor assembly.

FIG. 1, similarly to FIG. 12, shows only an intermeshing portion of a screw rotor assembly but which embodies the present invention. The screw rotor assembly comprises a male rotor 1 having male rotor teeth 1*a*, and a female rotor 2 having female rotor teeth 2*a*.

The male rotor tooth 1*a* consists of curves a-b, b-c, c-d, d-e, e-f and f-g successively arranged in that order from the leading side to the trailing side. The female rotor tooth 2*a* consists of curves A-B, B-C, C-D, D-E, E-F and F-G successively arranged in that order from the leading side to the trailing side. The respective forms of the curves are as follows.

(1) The curve a-b is an arc of the root circle $D_M$ of the male rotor teeth 1*a* having its center on the center O of the male rotor 1.

(2) The curve b-c is a generated curve corresponding to the curve B-C of the female rotor tooth 2*a*.

(3) The curve c-d is a generated curve corresponding to the curve C-D of the female rotor tooth 2*a*.

(4) The curve d-e is a curve with its origin at a point O'' on a straight line connecting the center O of the male rotor 1 and the center O' of the female rotor 2 and with a radius $r1=R1+R2(\theta_1/\theta_3)^n$, merging with the tip circle $A_M$ of the male rotor 1, where $\theta_1$ is a variable, $R2<0$, $|R2|>|R1|/2$, $0<\theta_3<90$, and $1<n<1.5$.

(5) The curve e-f is a generated curve corresponding to the curve E-F of the female rotor tooth 2*a*.

(6) The curve f-g is an arc of a cicle with its center on the pitch circle $P_M$ of the male rotor 1, merging with the root circle $D_M$ of the male rotor 1.

(7) The curve A-B is an arc of the tip circle $A_F$ of the female rotor 2.

(8) The curve B-C is an arc of a circle.

(9) The curve C-D is a curve with its origin at a pitch point O''' and with a radius $r2=\overline{R}+R3a(\theta_2/\theta_0)^n/\{b+(\theta_2/\theta_0)^n\}$ merging with the root circle $D_F$ of the female rotor 2, where $\theta_2$ is a variable, $a=\beta(1-\alpha^n)/(\beta-\alpha^n)$, $b=\alpha^n(1-\beta)/(\beta-\alpha^n)$, and when $\beta=0.5$, $0.7<\alpha<0.85$, and $2.5<n<3.5$.

(10) The curve D-E is a generated curve corresponding to the curve d-e of the male rotor tooth 1*a*.

(11) The curve E-F is a part of a hyperbola having the pole on a normal to the tangent line to the male rotor tooth 1*a* at a point E.

(12) The curve F-G is a arc of a circle with its center on the pitch circle $P_F$ of the female rotor 2 and merging with the tip circle $A_F$ of the female rotor 2.

Figure 13:
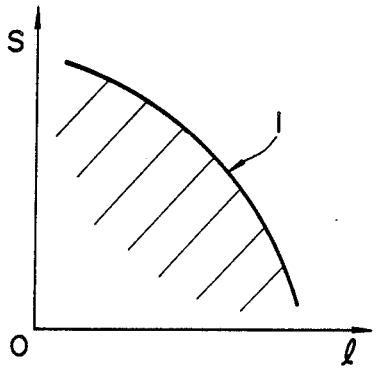
FIG. 13 is a graph showing the variation of the length L of the sealing line with the area S of blow hole.

The curve d-e is expressed by a function other than that of a circle so that the length l of the sealing line and the area S of the blow hole are located within the shaded area demarcated by the curve I in FIG. 13. Thus, the performance of the screw rotor assembly of the present invention is higher than that of the conventional screw rotor assembly.

Figure 2:
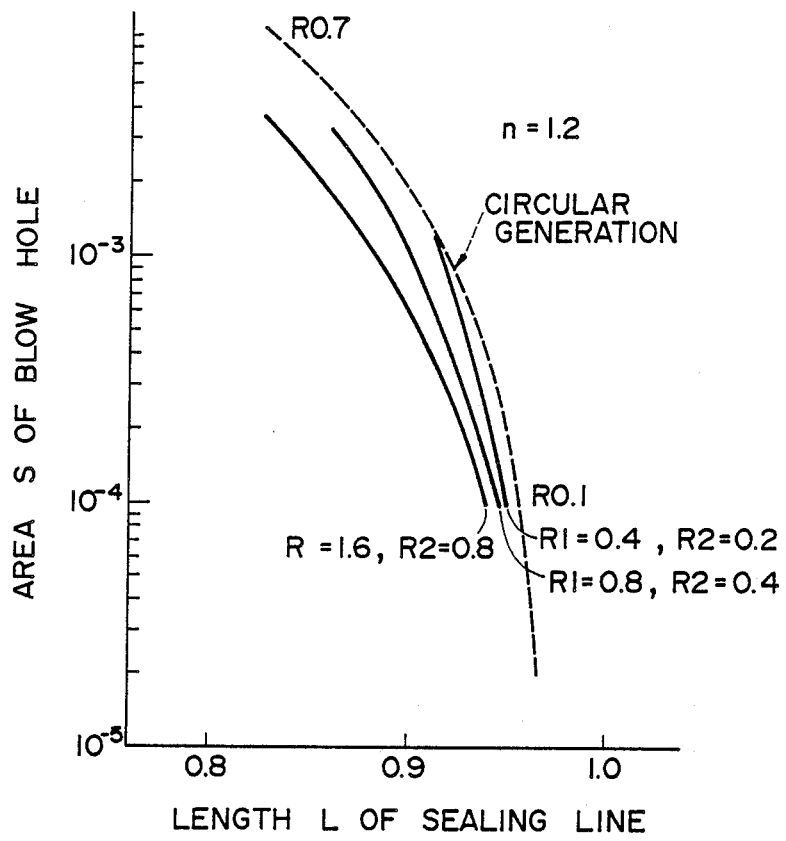
FIGS. 2 and 3 are graphs showing the relation between the length L of the sealing line in a portion formed of the curve d-e of the male rotor, and the area S of the blow hole.
Figure 3:
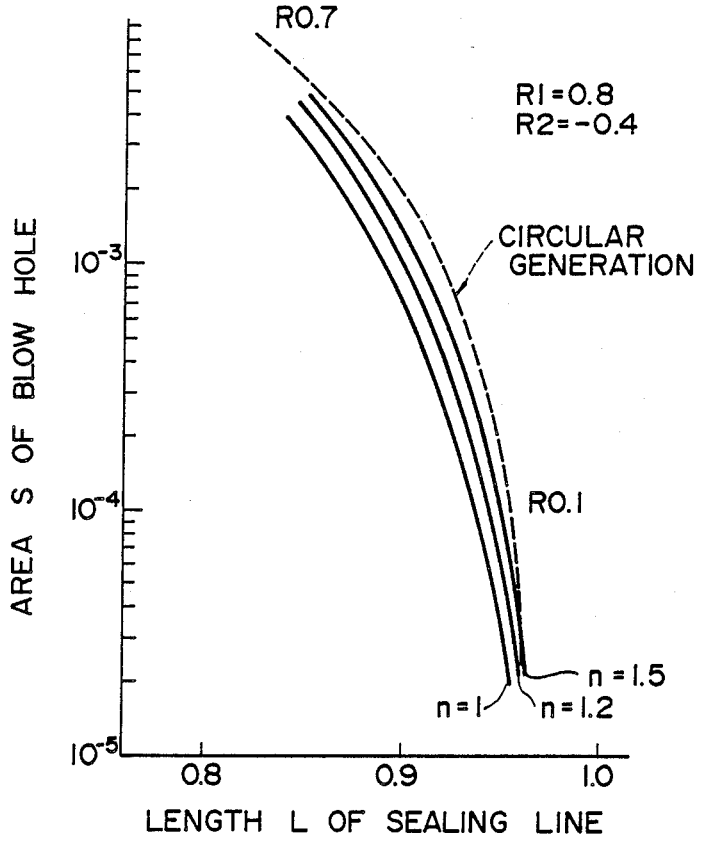

The dependence of the relation between the length L of the sealing line and the area S of the blow hole for R1, R2 and n is shown in FIGS. 2 and 3, in which $\theta_0$ is varied, R1, R2 and the n are constants, and broken lines represent the relation between the length l of sealing line and the area S of the blow hole in the conventional screw rotor assembly shown in FIG. 12, in which the curve corresponding to the curve d-e is circular. As is obvious from FIGS. 2 and 3, the area S of the blow hole of the screw rotor assembly of the present invention is reduced to approximately one-third of that of the conventional screw rotor assembly at a maximum for the same length L of sealing line.

Such reduction in the area S of the blow hole is possible because the area S of the blow hole decreases as the radius of curvature of the tip of the rotor teeth decreases, while the length L of the sealing line decreases, since the radius of curvature increases when the sealing point is shifted away from the tip of the rotor teeth.

Figure 4:
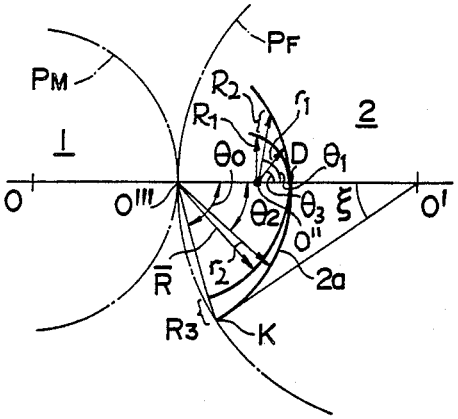
FIG. 4 is a diagram for assistance in explaining a method of deciding the curve C-D of the female rotor of FIG. 1.

Referring to FIG. 4, first, the position of a point K on the pitch circle $P_F$ is decided taking the tooth thickness of the female rotor tooth 2*a* into consideration. The form of the curve C-D is dependent on the selection of a curve connecting the points D and K. R3 and $\theta_0$ are parameters for deciding the point K.

$$\theta_0=\angle O'O'''K$$

$$R3=O''K-R$$

The function of the curve C-D is represented as $r_2=\overline{R}+R_3f(\theta)$.

Since the function $r_2=R+R_3f(\theta)$ includes the points D and K, the function $f(\theta)=a\theta^n/(b+\theta^n)$ must include points (0, 0) and (1, 1), when $\theta_2/\theta_0=\theta$.

Figure 5:
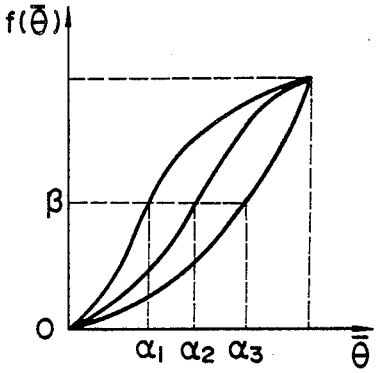
FIGS. 5, 6 and 7 are graphs showing the variations of a function $f(\overline{\theta})$, radius R and the length l of the sealing line in the xy plane with angle ratio $\overline{\theta}$ for $\alpha$, respectively.
Figure 6:
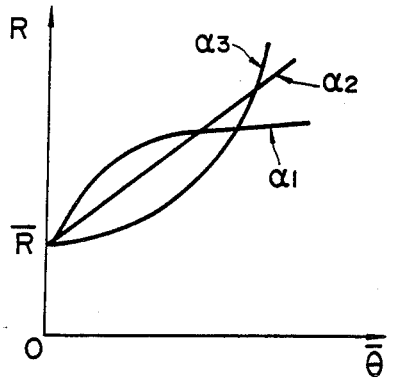
Figure 7:
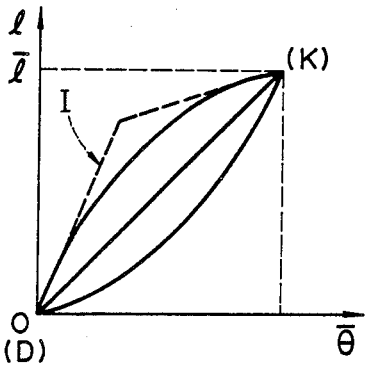

Supposing that $a=\beta(1-\alpha^n)/(\beta-\alpha^n)$ and $b=\alpha^n(1-\beta)/(\beta-\alpha^n)$ to facilitate the decision of the form of the function $f(\theta)$, then the function $f(\theta)$ includes points (0, 0), (1, 1) and ($\alpha$, $\beta$). When $\beta$ is an fixed value, and $\alpha$ is varied between $\alpha1$, $\alpha2$ and $\alpha3$ ($\alpha1>\alpha2>\alpha3$) as shown in FIG. 5, the variation of the radius of curvature R of the curve D-K with the angle ratio $\theta$ for $\alpha$ in the configuration shown in FIG. 4 is indicated by curves shown in FIG. 6. Consequently, as shown in FIG. 7, the length l of the sealing line in the xy plane varies with the angle ratio $\theta$ along a subsantially linear curve when $\alpha=\alpha2$, and along respective arcs of circles when $\alpha=\alpha1$ and $\alpha=\alpha3$. Since $\overline{l}$ is substantially fixed regardless of $\alpha$, the length of the sealing line decreases as the curve approaches a straight line. Since a shorter sealing line is desirable, it is undesirable that $\alpha$ is excessively large or excessively small when $f(\theta)=\beta$, because an excessively large $\alpha$ and an excessively small $\alpha$ increases the length of the sealing line.

Figure 8:
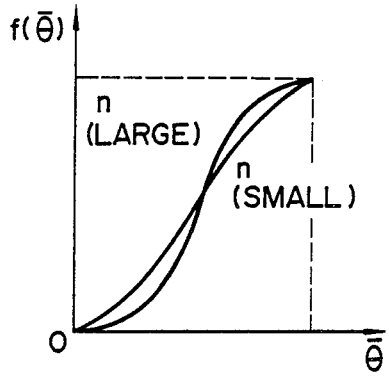
FIGS. 8 and 9 are graphs showing the variation of the function $f(\overline{\theta})$ and the radius R with the angle ratio $\overline{\theta}$ for n.
Figure 9:
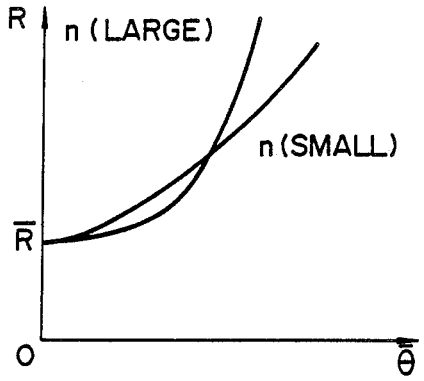

As is obvious from FIGS. 8 and 9, the effect of n on the variation of $f(\theta)$ and the radius of curvature R with $\theta$ is similar to that of $\alpha$.

Figure 11:
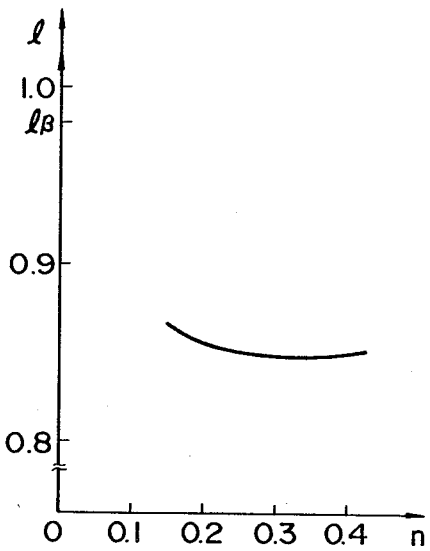
FIG. 11 is a graph showing the variation of the length L of the sealing line in a portion formed of the curve C-D of the female rotor tooth with n.
Figure 10:
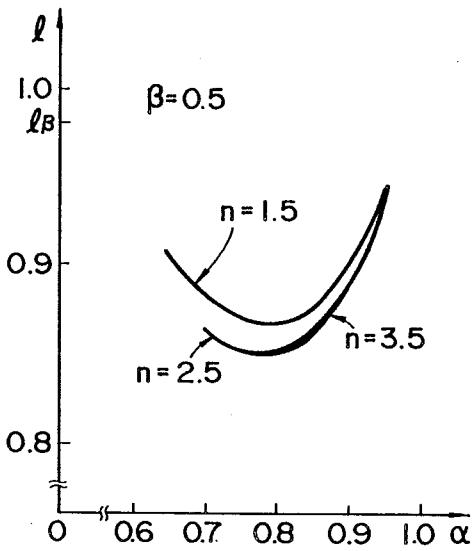
FIG. 10 is a graph showing the variation of the length L of the sealing line in a portion formed of the curve C-D of the female rotor tooth with $\alpha$ for n.

When $\overline{O'D}/\overline{O'O''}=0.6$ and $\xi=30°$ in FIG. 4, the variation of the length l of the sealing line with $\alpha$ for n is indicated by curves shown in FIG. 10, and the variation of the length l with n is indicated by a curve shown in FIG. 11. When $\beta=0.5$, $\alpha$ is in the range of 0.7 to 0.85 gives a minimum length l of sealing line, and hence it is preferable to define a and b by such values of $\alpha$ and $\beta$. Preferable values for n are in the range of 2.5 to 3.5. In FIGS. 10 and 11, $L\beta$ on the vertical axes indicates the length of sealing line in the conventional screw rotor assembly. The length L of the sealing line of the screw rotor assembly of the present invention is shorter than that of the conventional screw rotor assembly by approximately 15%.

In the screw rotor assembly of the present invention, the curve B-C is a hyperbola having a portion similar to an arc of a circle near the point B and a portion similar to a straight line near the point C. Therefore, the area S of blow hole is small, and the sealing point moves greatly as the rotors rotate, which suppresses the deterioration of the performance of the screw rotor assembly due to abrasion.

As is apparent from the foregoing description, since the male rotor teeth and female rotor teeth of the screw rotor assembly according to the present invention are formed respectively in the above-mentioned curvilinear forms a-b-c-d-e-f-g and A-B-C-D-E-F-G, the curve d-e reduces the length of sealing line and the area of blow hole, and the curves B-C-D-E reduce the length of sealing line. For example, the length of the sealing line and the area of the blow hole in the screw rotor assembly of the present invention are about 10% and about 50% of those in the conventional screw rotor assembly shown in FIG. 12, respectively. Thus, the present invention provides improved profiles for the male and female rotor teeth of the screw rotor assembly.

Although the invention has been described in its preferred form with a certain degree of particularity, obviously many variations and changes are possible therein. It is therefore to be understood that the invention may be practiced otherwise than specifically described herein without departing from the scope and spirit thereof.

What is claimed as new and desired to be secured by letters patent of the United States is;

1. A screw rotor assembly for a screw compressor or the like, comprising:

a male rotor having male rotor teeth each formed in a profile consisting of curves a-b, b-c, c-d, d-e, e-f and f-g; and a female rotor having female rotor teeth each formed in a profile consisting of curves A-B, B-C, C-D, D-E, E-F and F-G; wherein (a) the curve a-b is an arc of the root circle of the male rotor teeth with its center on the center O of the male rotor, (b) the curve b-c is a generated curve corresponding to the curve B-C of the female rotor tooth, (c) the curve c-d is a generated curve corresponding to the curve C-D of the female rotor tooth, (d) the curve d-e is a curve with its origin at a point O'' on a straight line connecting the center O of the male rotor and the center O' of the female rotor and with a radius $r1=R1+R2(\theta_1/\theta_3)^n$, merging with the tip circle of the male rotor, where $\theta_1$ is a variable, $R2<0$, $|R2|>|R1|/2$, $0<\theta_3<90$, and $1<n<1.5$, (e) the curve e-f is a generated curve corresponding to the curve E-F of the female rotor, (f) the curve f-g is an arc of a circle with its center on the pitch circle of the male rotor, merging with the root circle of the male rotor, (g) the curve A-B is an arc of the tip circle of the female rotor, (h) the curve B-C is an arc of a circle, (i) the curve C-D is a curve with its origin at a pitch point O''' and with a radius $r2=\overline{R}+R3a(\theta_2/\theta_0)^n/\{b+(\theta_2/\theta_0)^n\}$, merging with the root circle of the female rotor, where $\theta_2$ is a variable, $a=\beta(1-\alpha^n)$, $b=a^n(1-\beta)/(\beta-\alpha^n)$, and when $\beta=0.5$, $0.7\leqq\alpha\leqq0.85$ and $2.5\leqq n\leqq3.5$, (j) the curve D-E is a generated curve corresponding to the curve d-e of the male rotor, (k) the curve E-F is a part of a hyperbola having a pole normal to the male rotor tooth at a point E, and (l) the curve F-G is an arc of a circle with its center on the pitch circle of the female rotor and merging with the tip circle of the female rotor.

* * * * *